US007716961B2

(12) United States Patent
Hatou et al.

(10) Patent No.: US 7,716,961 B2
(45) Date of Patent: May 18, 2010

(54) METHOD FOR EXECUTING WATER JET PEENING

(75) Inventors: Hisamitu Hatou, Hitachi (JP); Noboru Saitou, Kasumigaura (JP); Ren Morinaka, Takahagi (JP); Tomohiko Motoki, Hitachinaka (JP); Tadashi Iijima, Ryugasaki (JP); Yuichi Koide, Hitachinaka (JP); Jun Kashiwakura, Tokai (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 0 days.

(21) Appl. No.: 12/198,951

(22) Filed: Aug. 27, 2008

(65) Prior Publication Data

US 2009/0056399 A1 Mar. 5, 2009

(30) Foreign Application Priority Data

Aug. 29, 2007 (JP) ..... 2007-221985
Aug. 20, 2008 (JP) ..... 2008-211276

(51) Int. Cl.
*B24C 1/10* (2006.01)
*B21D 41/00* (2006.01)

(52) U.S. Cl. ..... 72/53; 451/39; 451/40; 134/10; 134/30; 376/249; 376/260; 219/121.61; 219/121.84; 239/102.2

(58) Field of Classification Search ..... 72/53; 451/39, 40; 134/10, 30; 376/249, 260, 305, 376/316; 219/121.61, 121.84; 239/102.2, 239/102.3
See application file for complete search history.

(56) References Cited

U.S. PATENT DOCUMENTS 4,389,071 A * 6/1983 Johnson et al. ..... 239/380

(Continued)

FOREIGN PATENT DOCUMENTS

JP 06-047668 2/1994

(Continued)

OTHER PUBLICATIONS

"On a dropout incident of a part of a high-pressure core spray system of Simane nuclear power station No. 2 of the Chugoku Electric Power Co., Inc.", issued May 11, 2006 by Nuclear and Industrial Safety Agency in Ministry of Economy, Trade and Industry.

(Continued)

*Primary Examiner*—David B Jones
(74) *Attorney, Agent, or Firm*—Antonelli, Terry, Stout & Kraus, LLP.

(57) ABSTRACT

A method for executing water jet peening for giving an impact force to a surface of a structure member by a crushing pressure of a water jet and cavitation and improving residual stress, or washing, or reforming said surface, wherein said water jet peening is executed so as to make a natural frequency of oscillation of said structure member and a excitation frequency of oscillation of water jet peening different from each other.

12 Claims, 6 Drawing Sheets

U.S. PATENT DOCUMENTS

| | | | | | |
|---|---|---|---|---|---|
| 5,154,347 | A | * | 10/1992 | Vijay | 239/102.2 |
| 5,305,361 | A | * | 4/1994 | Enomoto et al. | 376/305 |
| 5,778,713 | A | * | 7/1998 | Butler et al. | 451/39 |
| 6,084,202 | A | * | 7/2000 | Okazaki et al. | 219/121.61 |
| 6,425,276 | B1 | * | 7/2002 | Hirano et al. | 134/10 |
| 6,502,442 | B2 | * | 1/2003 | Arola et al. | 72/53 |
| 6,519,991 | B2 | * | 2/2003 | Hirano et al. | 134/30 |
| 6,993,948 | B2 | * | 2/2006 | Offer | 72/53 |

FOREIGN PATENT DOCUMENTS

| | | |
|---|---|---|
| JP | 07-328855 | 12/1995 |

OTHER PUBLICATIONS

English translation of the "On a dropout incident of a part of a high-pressure core spray system of Simane nuclear power station No. 2 of the Chugoku Electric Power Co., Inc.", issued May 11, 2006 by Nuclear and Industrial Safety Agency in Ministry of Economy, Trade and Industry.

English version of Press Release about the "On a dropout incident of a part of a high-pressure core spray system of Simane nuclear power station No. 2 of the Chugoku Electric Power Co., Inc."

* cited by examiner

METHOD FOR EXECUTING WATER JET PEENING

CLAIM OF PRIORITY

The present application claims priority from Japanese Patent application serial no. 2007-221985, filed on Aug. 29, 2007 and Japanese Patent application serial no. 2008-211276, filed on Aug. 20, 2008, the content of which is hereby incorporated by reference into this application.

BACKGROUND OF THE INVENTION

The present invention relates to a method for executing a water jet peening for giving an impact force to a surface of a structure member by a crushing pressure of a water jet and cavitation and improving the residual stress, or washing, or reforming the surface.

In Japanese Patent Laid-open No. Hei 7(1995)-328855, in a water jet peening method, to enhance effect of the water jet peening, it is disclosed to change the stand-off distance, injection pressure, or injection collision time. In Japanese Patent Laid-open No. Hei 6(1994)-047668, in a water jet peening apparatus, to enhance effect of the water jet peening, it is disclosed to detect an impact pulse when cavitation is generated, and to set the conditions of the distance between an injection nozzle and a execution object of the water jet peening and the injection pressure from the injection nozzle.

SUMMARY OF THE INVENTION

In the prior arts aforementioned, the possibility of the execution object to resonate due to forced oscillation caused at the time of water jet peening is not taken into account.

An object of the present invention is to provide a method for executing a water jet peening for preventing a execution object of water jet peening from resonance.

The feature of the present invention to accomplish the above object is that the water jet peening is executed so as to make a natural frequency of oscillation of an object of water jet peening and a excitation frequency of oscillation of the water jet peening different from each other. Accordingly, the resonance of the execution object of the water jet peening can be suppressed.

To change the excitation frequency of oscillation of the water jet peening, the injection distance between an injection nozzle applied to water jet peening and the execution object of the water jet peening is changed. The relationship between the excitation frequency (Hz) of oscillation of the water jet peening and the injection distance (mm) can be predicted approximately by the following two 5th-degree polynomial expressions.

$$y = -1E-09x^5 + 1E-06x^4 - 0.0004x^3 + 0.0865x^2 - 8.8598x + 773 \quad (1)$$

$$y = 1E-09x^5 - 9E-07x^4 + 0.0002x^3 - 0.0197x^2 - 0.0274x + 272 \quad (2)$$

where a symbol y indicates the excitation frequency of oscillation of the water jet peening and x indicates the injection distance between the injection nozzle and the execution object of the water jet peening (hereinafter referred to as a execution object).

Under the condition of injection distance that the excitation frequency of oscillation of the water jet peening is away from the natural frequency of oscillation of the execution object by ±10% or more, if the water jet peening is executed, the response magnification is lowered, so that an occurrence of resonance can be prevented more.

In Equations (1) and (2), since the excitation frequency of oscillation of the water jet peening is changed largely within the range of a injection distance of 100 mm or shorter, this region is excellent in adjustability of the excitation frequency of oscillation of the water jet peening. Further, when the injection distance is shorter than 20 mm, it is not practical because erosion is apt to occur on the surface of the structure member. Therefore, the injection distance in the range from 20 mm to 100 mm where the adjustability of the excitation frequency of oscillation of the water jet peening is excellent and the erosion influences little on the surface of the structure member is preferable particularly.

Since in Equation (1), in the injection distance in the region from 100 mm to 250 mm, the excitation frequency of oscillation of the water jet peening is constant such as about 450 Hz and further even in Equation (2), in the injection distance within the region from 100 mm to 250 mm, the excitation frequency of oscillation of the water jet peening is constant such as about 200 Hz, when the natural frequency of oscillation of the execution object is other than about 200 Hz and about 450 Hz, the injection distance is selected between 100 mm and 250 mm, thus an occurrence of resonance can be prevented stably.

To change the excitation frequency of oscillation of the water jet peening, flow rate of water being jetted from the injection nozzle (hereinafter referred to as injection flow rate) is changed. The relationship between the excitation frequency (Hz) of oscillation of the water jet peening and the injection flow rate (L/min) can be predicted approximately by the following two linear approximate expressions.

$$y=-3.8x+631 \quad (3)$$

$$y=-4.1x+407 \quad (4)$$

where a symbol y indicates the excitation frequency of oscillation of the water jet peening and x indicates the injection flow rate. Under the condition of the injection flow rate that the excitation frequency of oscillation of the water jet peening is away from the natural frequency of oscillation of the execution object by ±10% or more, if the water jet peening is executed, the response magnification is lowered. Thus, an occurrence of resonance of the execution object can be prevented more. If the injection flow rate in the water jet peening is low, the width of stress being improved by one water jet peening becomes narrower. On the other hand, if the injection flow rate is high, the width of stress being improved by one peening becomes wider. However, the high-pressure pump for jetting high-pressure water increases in price. Therefore, the injection flow rate is selected within a range from 20 L/min to 50 L/min because in the injection flow rate within this range, the stress improvement width obtained by one water jet peening is wider, and the high-pressure pump is inexpensive. Accordingly, in the range from 20 L/min to 50 L/min, the industrial value of the water jet peening is kept and moreover an occurrence of resonance of the execution object can be prevented, so that this range is preferable particularly.

To change the excitation frequency of oscillation of the water jet peening, an inner diameter of an outlet of the injection nozzle being applied to the water jet peening is changed. The water is jetted from the outlet from the injection nozzle. The relationship between the excitation frequency (Hz) of oscillation of the water jet peening and the inner diameter (mm) of the outlet can be predicted approximately by the following two linear approximate expressions.

$$y=-151.3x+755 \quad (5)$$

$$y=-179x+576 \quad (6)$$

where a symbol y indicates the excitation frequency of oscillation of the water jet peening and x indicates the inner diameter (mm) of the outlet of the injection nozzle. Under the condition of this inner diameter that the excitation frequency of oscillation of the water jet peening is away from the natural frequency of oscillation of the execution object by ±10% or more, if the water jet peening is executed, the response magnification is lowered. Thus, an occurrence of resonance of the execution object can be prevented more. If the inner diameter of the outlet of the injection nozzle being applied to the water jet peening is small, the width of stress being improved by one water jet peening becomes narrower. On the other hand, if the inner diameter of the outlet of the injection nozzle is large, the width of stress being improved by one water jet peening becomes wider. However, the high-pressure pump for jetting high-pressure water increases in price. Therefore, the inner diameter of the outlet of the injection nozzle is selected between 1 mm and 2 mm because in the inner diameter in the range from 1 mm to 2 mm, the stress improvement width obtained by one water jet peening is wider, and the high-pressure pump is inexpensive. Accordingly, in the range from 1 mm to 2 mm, the industrial value is kept, and moreover an occurrence of resonance of the execution object can be prevented, so that this range is preferable particularly.

Namely, the method for executing the water jet peening of the present invention gives an impact force to the surface of the structure member by a crushing pressure of a water jet and cavitation and improves the residual stress, or washes, or reforms the surface, executes the water jet peening so as to make the natural frequency of oscillation of the execution object and the excitation frequency of oscillation of the water jet peening different from each other, thereby avoids resonance.

In the present invention, as a specific method for making the natural frequency of oscillation of the execution object and the excitation frequency of oscillation of water jet peening different from each other, the following are available.

(1) According to the natural frequency of oscillation of the execution object, the injection distance between the injection nozzle applied to the water jet peening and the execution object is changed.

(2) According to the natural frequency of oscillation of the execution object, the injection flow rate is changed.

(3) According to the natural frequency of oscillation of the execution object, the inner diameter of the outlet of the injection nozzle is changed.

The resonance of the execution object can be avoided by these specific methods.

According to the present invention, the possibility of resonance of an object of water jet peening can reduce.

DETAILED DESCRIPTION OF THE PREFERRED EMBODIMENTS

Figure 1:
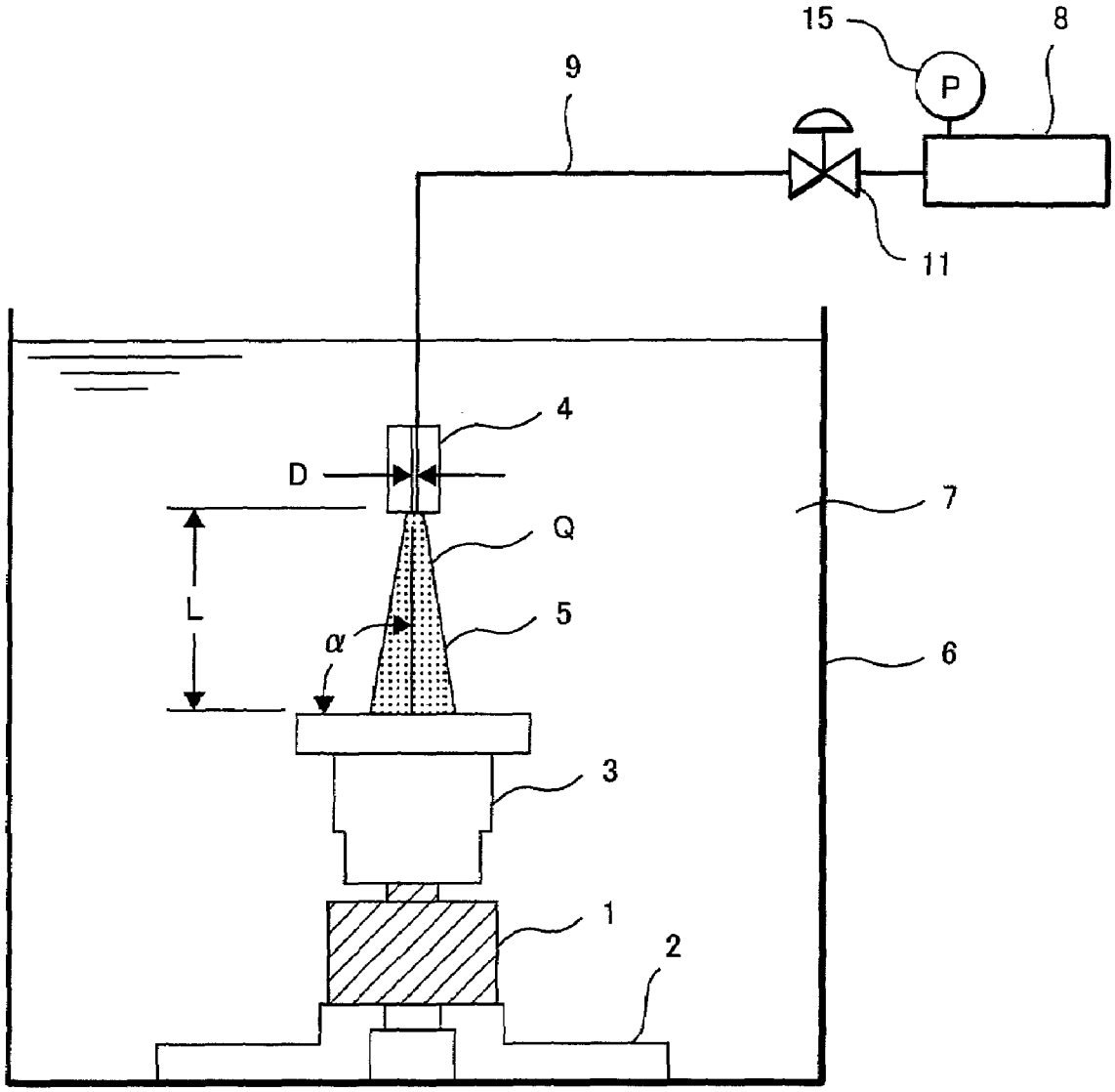
FIG. 1 is a structural diagram showing a measuring apparatus for measuring the excitation frequency of oscillation of water jet peening.

FIG. 1 shows a measuring apparatus for measuring the excitation frequency of oscillation of water jet peening.

A water jet peening apparatus has an injection nozzle 4, a high-pressure pump 8, a water leading tube 9 and a flow rate adjustment valve 11. The jet nozzle 4 is connected to the high-pressure pump 8 by the water leading tube 9. The flow rate adjustment valve 11 is attached to the water leading tube 9.

To a load cell 1 for measuring the load, a fixing tool 2 and a jet receiving plate 3 are attached. These are disposed in a water bath 6 and fixed to the water bath 6. Pure water 7 pressurized by the high-pressure pump 8 is supplied to the injection nozzle 4 via the flow rate adjustment valve 11 and the water leading tube 9. An injection pressure P of the pure water discharged from the high-pressure pump 8 is measured with a pressure gauge 15 mounted on the high-pressure pump 8. In the injection nozzle 4, a small-diameter hole for increasing the injection speed of the pure water is formed. The small-diameter hole is an outlet of the injection nozzle 4. An inner diameter of the outlet of the injection nozzle 4 is called a nozzle diameter D. The pure water 7 jetted from the injection nozzle 4 becomes a water jet 5 and collides with the jet receiving plate 3.

The measuring apparatus has a mechanism for detecting the load caused by the collision of the water jet 5 by the load cell 1. The measuring apparatus analyzes the load data detected by the load cell 1 and evaluates the excitation frequency of oscillation of the water jet peening. Here, the distance from the injection nozzle 4 to the jet receiving plate 3 is assumed as a injection distance L, the angle between the injection nozzle 4 and the jet receiving plate 3 as an injection angle $\alpha$, the flow rate of a water jet 5 jetted from the injection nozzle 4 as a injection flow rate Q, and the pressure measured by the pressure gauge 15 as a injection pressure P. The main specifications for measurement are indicated below.

Rated capacity of load cell: ±10 kN

The rated capacity is set sufficiently larger than the load generated by water jet peening.

Natural frequency of oscillation of load cell: 21 kHz

When the natural frequency of oscillation of the load cell 1 is small, since there are possibilities that the load cell 1 itself may resonate with the excitation frequency of oscillation of the water jet peening, the load cell 1 is set to a natural frequency of oscillation sufficiently larger than the excitation frequency of oscillation of the water jet peening.

Measurement frequency: 4096 Hz

So as to enable to measure sufficiently the excitation frequency of oscillation of the water jet peening, the measurement frequency is set to about 10 times of the excitation frequency of oscillation of the water jet peening.

Measurement time: for 10 seconds from 10 seconds after injection

The measurement time is set so as to measure after the oscillation characteristic is stabilized.

Further, the measurement system entering water is all waterproofed.

Figure 2:
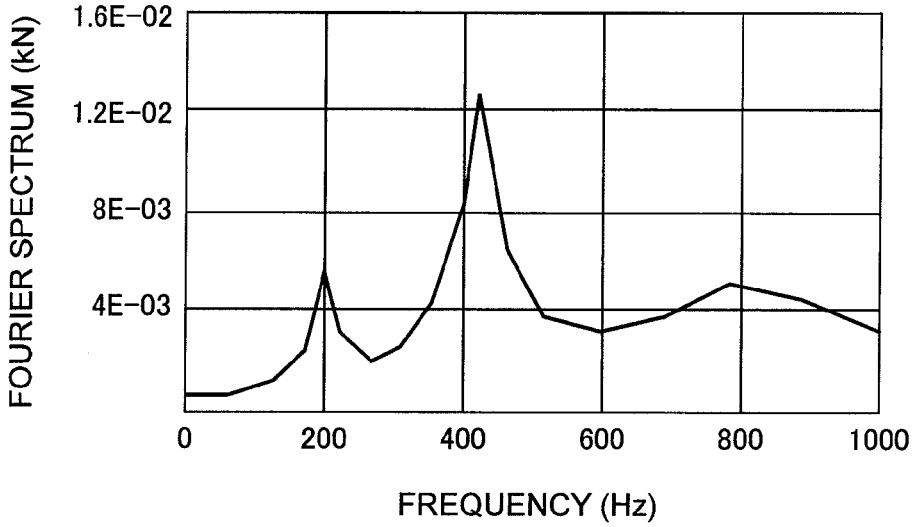
FIG. 2 is an explanatory drawing showing a representative example of the measured results of a excitation frequency of oscillation of water jet peening which are analyzed an oscillation frequency.

FIG. 2 shows a representative example of the frequency analytical results of the load data obtained under the conditions of the nozzle diameter D of 2 mm, the injection flow rate Q of 48 L/min, the injection distance L of 150 mm, the injection angle α of 90°, and the injection pressure P of 70 MPa. The frequency analytical results are obtained by the high-speed Fourier transportation of the obtained data.

From FIG. 2, it is found that the excitation frequency of oscillation of the water jet peening is about 200 Hz and about 450 Hz. Therefore, if the natural frequency of oscillation of an execution object coincides with the excitation frequency of oscillation of the water jet peening, it is found that resonance may occur.

Figure 3:
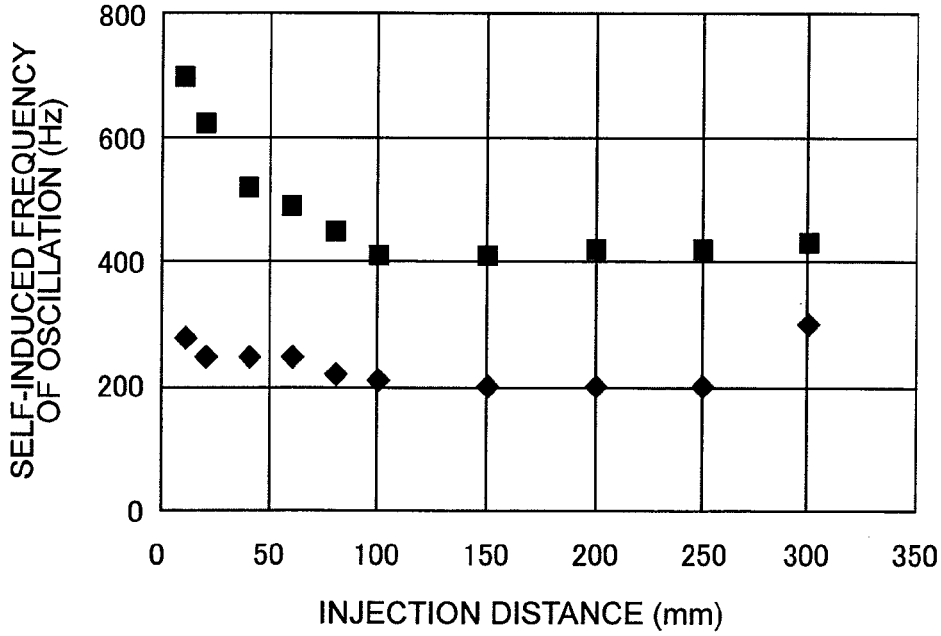
FIG. 3 is an explanatory drawing showing a change of the excitation frequency of oscillation of water jet peening when the injection distance is expressed as a parameter within a range from 10 mm to 300 mm.

FIG. 3 shows the change of the excitation frequency of oscillation of the water jet peening when the injection distance L is expressed as a parameter within the range from 10 mm to 300 mm, under the conditions of the nozzle diameter D of 2 mm, the injection flow rate Q of 48 L/min, the injection angle α of 90°, and the injection pressure P of 70 MPa. From FIG. 3, it is found that the excitation frequency of oscillation of the water jet peening changes according to the injection distance L.

Figure 4:
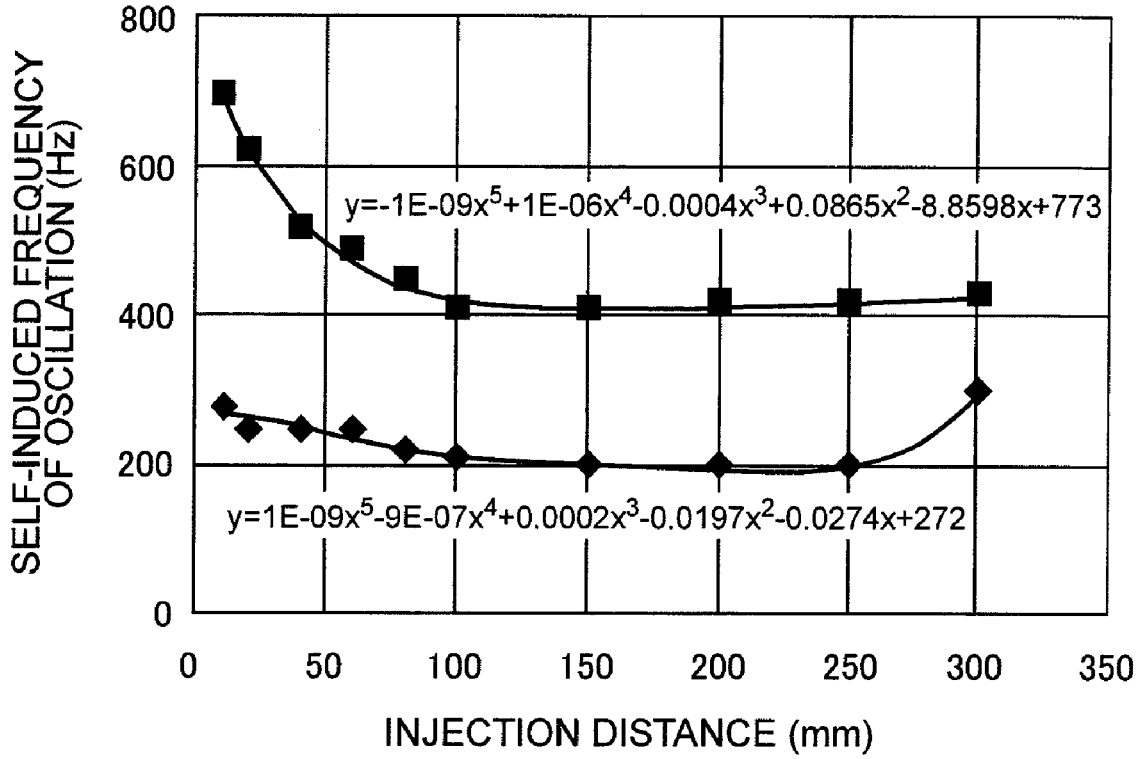
FIG. 4 is an explanatory drawing showing the results in FIG. 3 indicated by the 5th-degree approximate equations.

FIG. 4, on the basis of the data shown in FIG. 3, shows the relationship between the excitation frequency of oscillation of the water jet peening and the injection distance L using the approximate curves and approximate equations which are approximated by the 5th-degree polynomial equations having an excellent approximation. From the approximate equations, it is found that the relationship between the excitation frequency of oscillation of the water jet peening and the injection distance L is expressed by the following Equatins.

$$y = -1E-09x^5 + 1E-06x^4 - 0.0004x^3 + 0.0865x^2 - 8.8598x + 773 \quad (1)$$

$$y = 1E-09x^5 - 9E-07x^4 + 0.0002x^3 - 0.0197x^2 - 0.0274x + 272 \quad (2)$$

where a symbol y indicates the excitation frequency (Hz) of oscillation of the water jet peening and x indicates the injection distance L (mm) between the injection nozzle applied to the water jet peening and the execution object.

Therefore, when the natural frequency of oscillation of the execution object coincides with the excitation frequency of oscillation of the water jet peening, resonance may occur. Thus, by obtaining beforehand the natural frequency of oscillation of the execution object by measurement and analysis and selecting the injection distance L from Equations (1) and (2) so as to make it different from its natural frequency, the execution object can be prevented from resonance. Further, under the condition of the injection distance that the excitation frequency of oscillation of the water jet peening is away from the natural frequency of oscillation of the execution object by ±10% or more, if the water jet peening is executed, the response magnification is lowered, so that an occurrence of resonance can be prevented more.

In Equations (1) and (2), since the excitation frequency of oscillation of the water jet peening is changed largely within the range of a injection distance of 100 mm or shorter, this region is excellent in adjustability of the excitation frequency of oscillation of the water jet peening. Further, when the injection distance is shorter than 20 mm, it is not practical because erosion is apt to occur on the surface of the structure member. Therefore, the injection distance within the range from 20 mm to 100 mm where the adjustability of the excitation frequency of oscillation of the water jet peening is excellent and the erosion influences little on the surface of the structure member is preferable particularly.

Since in Equation (1), in the injection distance in the region from 100 mm to 250 mm, the excitation frequency of oscillation of the water jet peening is constant such as about 450 Hz and further even in Equation (2), in the injection distance in the region from 100 mm to 250 mm, the excitation frequency of oscillation of the water jet peening is constant such as about 200 Hz, when the natural frequency of oscillation of the execution object is other than about 200 Hz and about 450 Hz, the injection distance is selected between 100 mm and 250 mm, thus an occurrence of resonance can be prevented stably.

Figure 5:
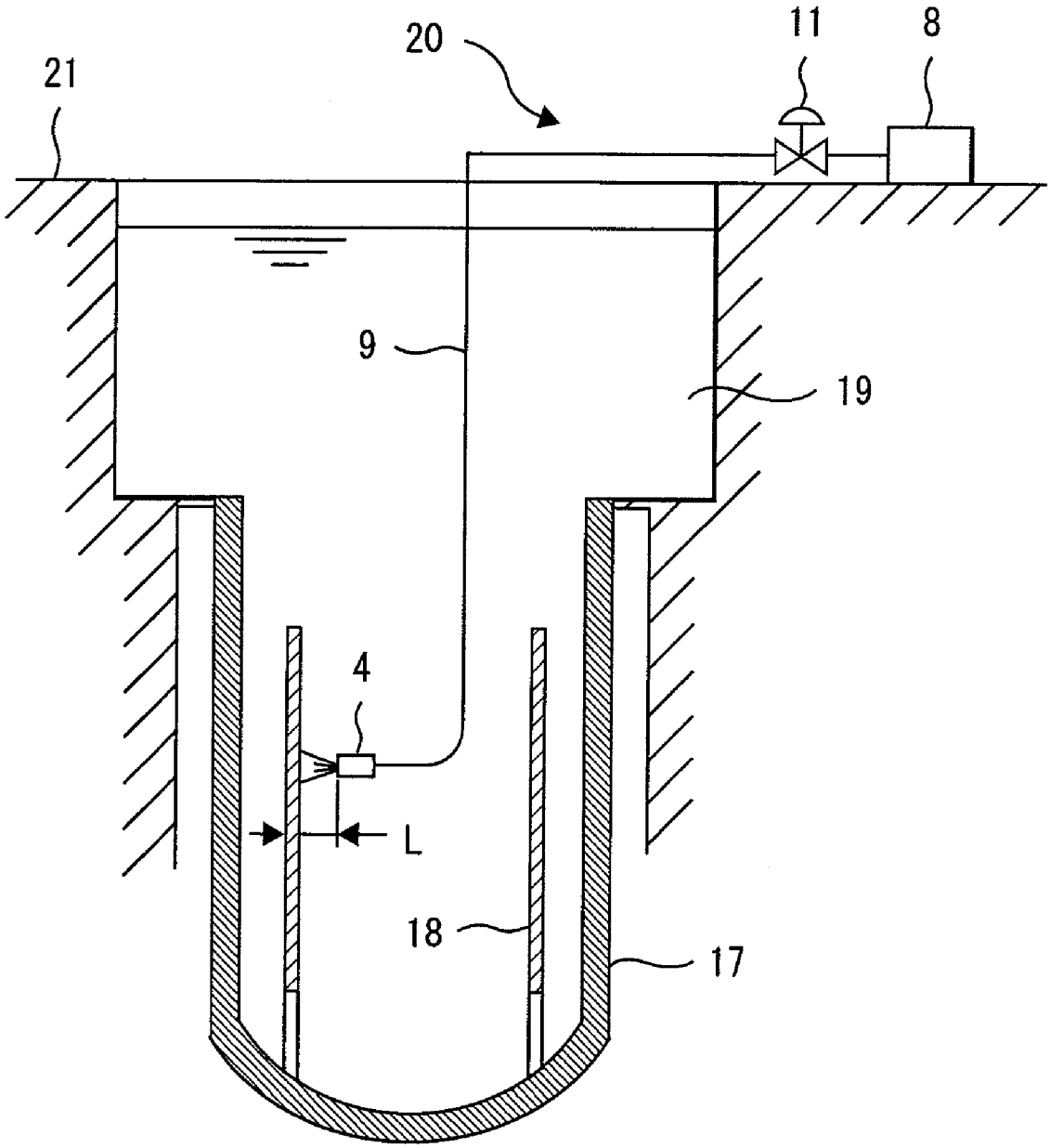
FIG. 5 is an explanatory drawing showing a method for executing a water jet peening of one preferable embodiment of the present invention.

A method for executing a water jet peening of a first embodiment which is one preferable embodiment of the present invention will be described with reference to FIG. 5. The present embodiment is reflected the above study results. The method for executing a water jet peening of the present embodiment is applied to a core shroud 18 located in a reactor pressure vessel 17 of a boiling water reactor. The core shroud 18 is surrounded a core (not shown) arranged in the reactor pressure vessel 17. This core shroud 18 is the object of the water jet peening (execution object).

The reactor pressure vessel 17 and a reactor well 19 arranged above the reactor pressure vessel 17 are filled with cooling water. A water jet peening apparatus 20 has an injection nozzle 4, a high-pressure pump 8, a water leading tube 9 and a flow rate adjustment valve 11. The jet nozzle 4 is connected to the high-pressure pump 8 by the water leading tube 9. The flow rate adjustment valve 11 is attached to the water leading tube 9. The injection nozzle 4 has a same structure as the nozzle 4 shown in FIG. 1.

The high-pressure pump 8 and the clarification apparatus 15 are installed on an operation flour 21 above the reactor well 19. When the water jet peening is executed for the core shroud 18, the injection nozzle 4 attached to a manipulator (not shown) is located in the core shroud 18 by the manipulator and soaked in the cooling water in the core shroud 18. The outlet of the injection nozzle 4 faces toward the core shroud 18. The injection distance and the injection nozzle 4 and the core shroud 18 is 200 mm in the present embodiment.

The high-pressure pump 8 is started up and the pure water pressurized by the high-pressure pump is introduced into the injection nozzle 4 through the water leading tube 9. The pressurized pure water is jetted from the outlet of the injection nozzle 4 to an inner surface of the core shroud 18. The water jet jetted from the injection nozzle 4 is collided on the inner surface of the core shroud 18. Cavities included in the water jet 5 are crushed and impact wave is generated. The impact wave collides with the inner surface of the core shroud 18 and an impact force is given to the inner surface of the core shroud 18 by working of the impact wave. Compression residual stress is given to an inner surface portion of the core shroud 18. Since the injection distance L between the injection nozzle 4 and the inner surface of the core shroud 18, excitation frequency of oscillation generated in the core shroud 18 by the water jet peening is different from natural frequency of oscillation of the core shroud 18. Accordingly, in the core shroud 18, an occurrence of resonance can be prevented stably.

Figure 6:
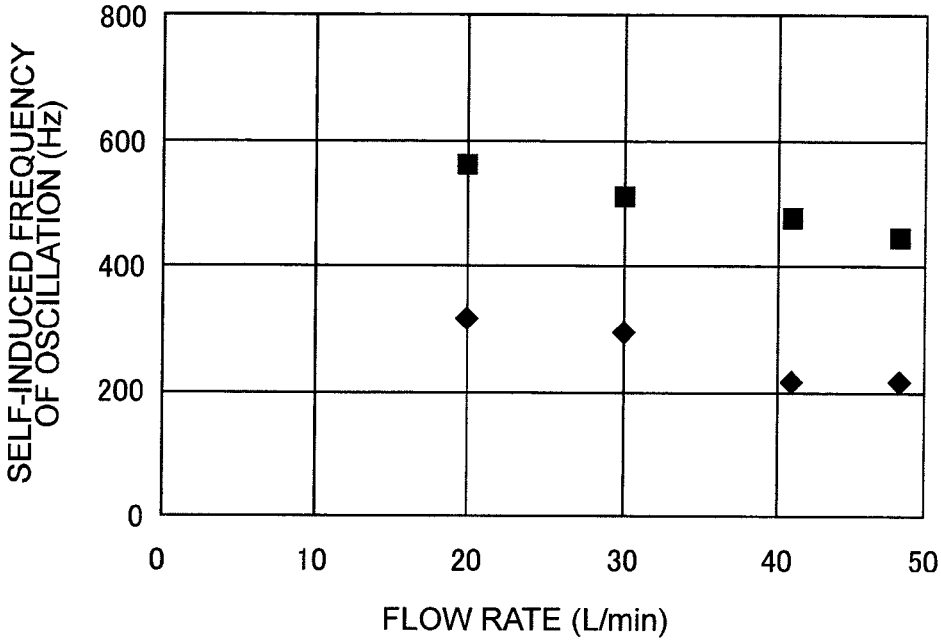
FIG. 6 is an explanatory drawing showing a change of the excitation frequency of oscillation of water jet peening when injection flow rate of water is expressed as a parameter within a range from 20 L/min to 48 L/min.

FIG. 6 shows a change of the excitation frequency of oscillation of the water jet peening when the injection pressure P is adjusted under the conditions of the nozzle diameter D of 2 mm, the injection distance L of 150 mm, and the injection angle α of 90° and the injection flow rate Q is expressed as a parameter within the range from 20 L/min to 48 L/min. From FIG. 6, it is found that the excitation frequency of oscillation of the water jet peening changes according to the injection flow rate Q.

Figure 7:
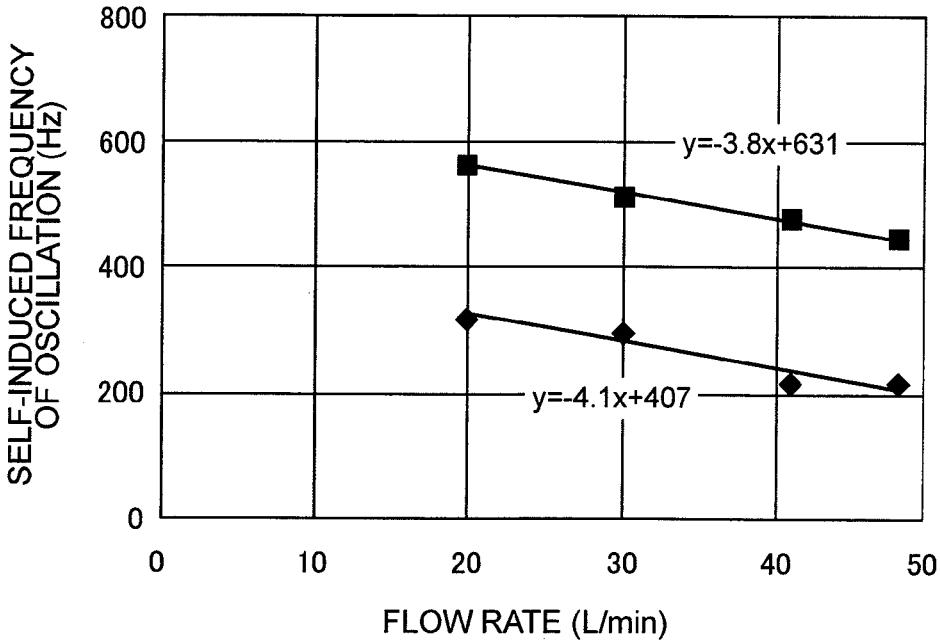
FIG. 7 is an explanatory drawing showing the results in FIG. 6 indicated by the linear approximate equations.

FIG. 7, on the basis of the data shown in FIG. 6, shows a relationship between the excitation frequency of oscillation of the water jet peening and the injection distance L using the approximate curves and approximate equations which are approximated by the linear approximate equations. From the approximate equations, it is found that the relationship between the excitation frequency of oscillation of the water jet peening and the injection flow rate Q is expressed by the following Equations.

$$y=-3.8x+631 \quad (3)$$

$$y=-4.1x+407 \quad (4)$$

where a symbol y indicates the excitation frequency of oscillation of the water jet peening (Hz) and x indicates the injection flow rate (L/min).

Therefore, when the natural frequency of oscillation of the object of water jet peening coincides with the excitation frequency of oscillation of the water jet peening, resonance may occur. Thus, by obtaining beforehand the natural frequency of oscillation of the object of water jet peening by measurement and analysis and selecting the injection flow rate Q from Equations (3) and (4) so as to make it different from its natural frequency, the execution object can be prevented from resonance. Further, under the condition of the injection flow rate that the excitation frequency of oscillation of the water jet peening is away from the natural frequency of oscillation of the execution object by ±10% or more, if the water jet peening is executed, the response magnification is lowered, so that an occurrence of resonance can be prevented more.

If the injection flow rate in the water jet peening is low, the width of stress being improved by one water jet peening becomes narrower. On the other hand, if the injection flow rate is high, the width of stress being improved by one peening becomes wider. However, the high-pressure pump for jetting high-pressure water increases in price. Therefore, the injection flow rate is selected within a range from 20 L/min to 50 L/min because in the injection flow rate within this range, the stress improvement width obtained by one water jet peening is wider, and the high-pressure pump is inexpensive. Accordingly, in the range from 20 L/min to 50 L/min, the industrial value of the water jet peening is kept and moreover an occurrence of resonance of the execution object can be prevented, so that this range is preferable particularly.

A method for executing a water jet peening of a second embodiment which is another embodiment of the present invention will be described with reference to FIG. 5. In the present embodiment, flow rate Q of the pure water being supplied to the injection nozzle 4 (injection flow rate Q), that is, flow rate Q of the water jet 5 is adjusted by the flow rate adjustment valve 11. The injection flow rate is 48 L/min. In the present embodiment, the compression residual stress is given to an inner surface portion of the core shroud 18 as in the case of the first embodiment. Since the injection flow rate Q is 30 L/min, excitation frequency of oscillation generated in the core shroud 18 by the water jet peening is different from natural frequency of oscillation of the core shroud 18. Accordingly, in the core shroud 18, an occurrence of resonance can be prevented stably.

Figure 8:
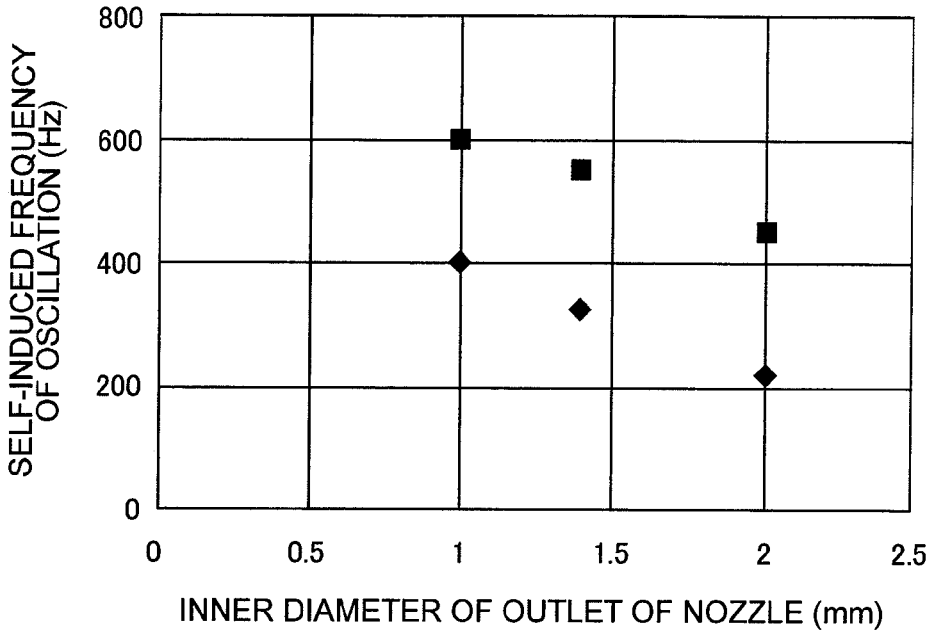
FIG. 8 is an explanatory drawing showing a change of the excitation frequency of oscillation of water jet peening when an inner diameter of the outlet of the injection nozzle is expressed as a parameter within a range from 1 mm to 2 mm.

FIG. 8 shows a change of the excitation frequency of oscillation of the water jet peening when the nozzle diameter D is expressed as a parameter within the range from 1 mm to 2 mm under the conditions of the injection distance L of 150 mm, the injection angle α of 90°, and the injection pressure P of 70 MPa. The injection flow rate Q varies with the nozzle diameter D and decreases when the nozzle diameter D becomes smaller. From FIG. 8, it is found that the excitation frequency of oscillation of the water jet peening changes according to the nozzle diameter D.

Figure 9:
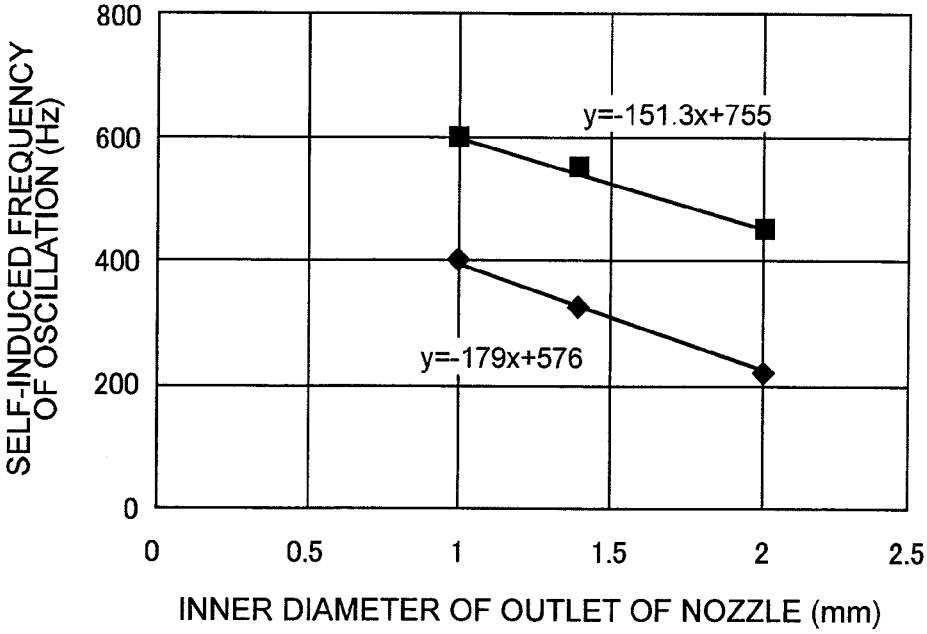
FIG. 9 is an explanatory drawing showing the results in FIG. 8 indicated by the linear approximate equations.

FIG. 9, on the basis of the data shown in FIG. 8, shows a relationship between the excitation frequency of oscillation of the water jet peening and the nozzle diameter D using the approximate curves and approximate equations which are approximated by the linear approximate equations. From the approximate equations, it is found that the relationship between the excitation frequency of oscillation of the water jet peening and the nozzle diameter D is expressed by the following Equations.

$$y=-151.3x+755 \quad (5)$$

$$y=-179x+576 \quad (6)$$

where a symbol y indicates the excitation frequency (Hz) of oscillation of the water jet peening and x indicates the nozzle diameter (mm).

Therefore, when the natural frequency of oscillation of the execution object coincides with the excitation frequency of oscillation of the water jet peening, there are possibilities that resonance may occur. Thus, by obtaining beforehand the natural frequency of oscillation of the object of water jet peening by measurement and analysis and selecting the nozzle diameter D from Equations (5) and (6) so as to make it different from its natural frequency, the execution object can be prevented from damage. Further, under the condition of the nozzle diameter D that the excitation frequency of oscillation of the water jet peening is away from the natural frequency of oscillation of the execution object by ±10% or more, if the water jet peening is executed, the response magnification is lowered, so that an occurrence of resonance can be prevented more.

If the inner diameter of the outlet of the injection nozzle being applied to the water jet peening is small, the width of stress being improved by one water jet peening becomes narrower. On the other hand, if the inner diameter of the outlet of the injection nozzle is large, the width of stress being improved by one water jet peening becomes wider. However, the high-pressure pump for jetting high-pressure water increases in price. Therefore, the inner diameter of the outlet of the injection nozzle is selected between 1 mm and 2 mm because in the inner diameter in the range from 1 mm to 2 mm, the stress improvement width obtained by one water jet peening is wider, and the high-pressure pump is inexpensive. Accordingly, in the range from 1 mm to 2 mm, the industrial value is kept, and moreover an occurrence of resonance of the execution object can be prevented, so that this range is preferable particularly.

A method for executing a water jet peening of a third embodiment which is another embodiment of the present invention will be described with reference to FIG. 5. In the water jet peening apparatus 20 being used in the present embodiment, the injection nozzle 4 includes an outlet having an inner diameter of 2.0 mm. The water jet peening is executed by using the injection nozzle 4 including the outlet having the inner diameter of 2.0 mm as in the case of the first embodiment. In the present embodiment, the compression residual stress is given to an inner surface portion of the core shroud 18. Since the injection nozzle 4 including the outlet having the inner diameter of 2.0 mm is used, excitation frequency of oscillation generated in the core shroud 18 by the water jet peening is different from natural frequency of oscillation of the core shroud 18. Accordingly, in the core shroud 18, an occurrence of resonance can be prevented stably.

As mentioned above, according to the first, second and third embodiment, the water jet peening is executed so that the natural frequency of oscillation of an execution object and the excitation frequency of oscillation of the water jet peening are made different from each other, thus the possibility of resonance of the execution object can be reduced.

The present invention can be applied to apparatuses including the atomic power equipment necessary to give an impact force to a surface of a structure member by a crushing pressure of a water jet and cavitation and to improve the residual stress, or wash, or modify the surface.

What is claimed is:

1. Method for executing water jet peening for giving an impact force to a surface of a structure member by a crushing pressure of a water jet and cavitation and improving residual stress of said surface, wherein said water jet peening is executed so as to make a natural frequency of oscillation of said structure member and an excitation frequency of oscillation of said water jet peening different from each other.

2. A method for executing water jet peening according to claim 1, wherein the step for making said natural frequency of oscillation of said structure member and said excitation frequency of oscillation of said water jet peening different from each other includes a step for setting a distance between an injection nozzle used in said water jet peening and said structure member based on said natural frequency of oscillation of said structure member.

3. A method for executing water jet peening according to claim 1, wherein the step for making said natural frequency of oscillation of said structure member and said excitation frequency of oscillation of said water jet peening different from each other includes a step for adjusting a flow rate of water jetted from an injection nozzle used in said water jet peening based on said natural frequency of oscillation of said structure member.

4. A method for executing water jet peening according to claim 1, wherein the step for making said natural frequency of oscillation of said structure member and said excitation frequency of oscillation of said water jet peening different from each other includes a step for setting an inner diameter of an outlet of an injection nozzle used in said water jet peening based on said natural frequency of oscillation of said structure member.

5. A method for executing water jet peening according to claim 2, wherein said distance is set between 20 mm and 100 mm.

6. A method for executing water jet peening according to claim 3, wherein said flow rate of said water is adjusted within range from 20 L/min to 50 L/min.

7. A method for executing water jet peening according to claim 4, wherein said inner diameter of said outlet is within a range from 1 mm to 2 mm.

8. A method for executing water jet peening for giving an impact force to a surface of a structure member by a crushing pressure of a water jet and cavitation and improving residual stress, or washing, or reforming said surface, wherein when said structure member has a natural frequency of oscillation other than 200 Hz and 450 Hz, a distance between an injection nozzle and said structure member is set within a range from 100 mm to 250 mm.

9. A method for executing water jet peening for executing at least one of improvement of residual stress, washing and reformation of a surface of a structure member by a water jet or cavitation, wherein an excitation frequency of oscillation of said water jet is set different from a natural frequency of oscillation of said structure member.

10. A method for executing water jet peening according to claim 9, wherein a distance between an injection nozzle used in said water jet peening and said structure member is set within a range from 20 mm to 100 mm.

11. A method for executing water jet peening according to claim 9, wherein a flow rate of water jetted from an injection nozzle used in said water jet peening is adjusted within a range from 20 L/min to 50 L/min.

12. A method for executing water jet peening according to claim 9, wherein an inner diameter of an outlet of an injection nozzle used in said water jet peening is within a range from 1 mm to 2 mm.

* * * * *